US010078975B2

(12) United States Patent
Stadjuhar, Jr.

(10) Patent No.: US 10,078,975 B2
(45) Date of Patent: Sep. 18, 2018

(54) HIGHWAY VARIABLE MESSAGE SIGN WITH APERTURES

(71) Applicant: Skyline Products, Inc., Colorado Springs, CO (US)

(72) Inventor: Robert Charles Stadjuhar, Jr., Colorado Springs, CO (US)

( * ) Notice: Subject to any disclaimer, the term of this patent is extended or adjusted under 35 U.S.C. 154(b) by 455 days.

(21) Appl. No.: 14/802,440

(22) Filed: Jul. 17, 2015

(65) Prior Publication Data

US 2015/0325156 A1 Nov. 12, 2015

Related U.S. Application Data

(63) Continuation-in-part of application No. 12/888,241, filed on Sep. 22, 2010, now Pat. No. 9,343,000.

(60) Provisional application No. 62/110,507, filed on Jan. 31, 2015.

(51) Int. Cl.

| | |
|---|---|
| ***G09F 9/33*** | (2006.01) |
| ***G09F 13/22*** | (2006.01) |
| ***G09F 19/22*** | (2006.01) |

(52) U.S. Cl.

CPC ..... *G09F 9/33* (2013.01); *G09F 13/22* (2013.01); *G09F 19/22* (2013.01); *G09F 2013/222* (2013.01)

(58) Field of Classification Search

CPC ..... G09F 13/04; G09F 13/00; G09F 13/14; G09F 13/28; F21S 10/02

See application file for complete search history.

(56) References Cited

U.S. PATENT DOCUMENTS

| | | | | |
|---|---|---|---|---|
| 4,970,812 | A | 11/1990 | Tanaka et al. | |
| 5,388,035 | A * | 2/1995 | Bodem, Jr. | B60Q 1/2696 362/240 |
| 5,715,619 | A | 2/1998 | Polisois et al. | |
| 6,364,507 | B1 | 4/2002 | Yang | |
| 6,379,209 | B1 | 4/2002 | Tucker | |
| 6,677,918 | B2 | 1/2004 | Yuhara et al. | |
| 6,741,222 | B1 | 5/2004 | Tucker | |
| 7,284,881 | B2 | 10/2007 | Kim et al. | |
| 7,559,673 | B2 | 7/2009 | Meersman et al. | |
| 2003/0058191 | A1 * | 3/2003 | Yuhara | G09F 9/33 345/44 |
| 2004/0123501 | A1 * | 7/2004 | Safavi | G09F 9/33 40/452 |

(Continued)

*Primary Examiner* — Cassandra Davis

(74) *Attorney, Agent, or Firm* — Aspire IP, LLC; Scott J. Hawranek

(57) ABSTRACT

Embodiments of a highway variable message sign with apertures are generally described herein. Various embodiments of a highway message sign comprise a housing and one or more circuit boards. In many embodiments, each of the one or more circuit boards have a plurality of pixels, and each pixel of the plurality of pixels can include one or more lighting elements. The highway message sign can further comprise a glazing adjacent to the lighting elements and a mask attached to the housing and adjacent to the glazing. The mask can have a plurality of apertures aligned with the plurality of pixels at an offset, wherein each pixel of the plurality of pixels is aligned at a different one of the plurality of apertures such that the one or more lighting elements of any pixel of the plurality of pixels are aligned to the same aperture. Other embodiments may be described and claimed.

46 Claims, 9 Drawing Sheets

(56) References Cited

U.S. PATENT DOCUMENTS

| | | | | |
|---|---|---|---|---|
| 2006/0279493 | A1 | 12/2006 | Syrstad | |
| 2007/0008259 | A1* | 1/2007 | Barker | G09F 9/30 345/84 |
| 2008/0098634 | A1 | 5/2008 | Stadjuhar | |
| 2008/0120880 | A1 | 5/2008 | Stadjuhar | |
| 2008/0141570 | A1* | 6/2008 | Nearman | G09F 9/30 40/574 |
| 2008/0225143 | A1 | 9/2008 | Joffer et al. | |
| 2008/0266206 | A1* | 10/2008 | Nelson | G09F 9/33 345/1.3 |
| 2011/0051409 | A1 | 3/2011 | Nearman | |

* cited by examiner

HIGHWAY VARIABLE MESSAGE SIGN WITH APERTURES

CROSS-REFERENCE TO RELATED APPLICATIONS

The present application is a continuation-in-part of U.S. patent application Ser. No. 12/888,241, entitled "Fine Pitch Full Color Variable Message Sign," filed on Sep. 22, 2010, and claims priority to U.S. Provisional Patent Application No. 62/110,507, entitled "Multiple Sign Controller," filed on Jan. 31, 2015, both of which are hereby incorporated by reference.

BACKGROUND

Variable message signs are used to display messages to motorists and provide them information about hazards, accidents ahead, weather information, etc. There has been a push to provide variable message signs that provide more detail and/or are in color. There has also been a problem with signs being visible to motorists that are not the intended viewers of the variable message sign. Adding multiple lighting elements per aperture only increases this problem.

Figure 1:
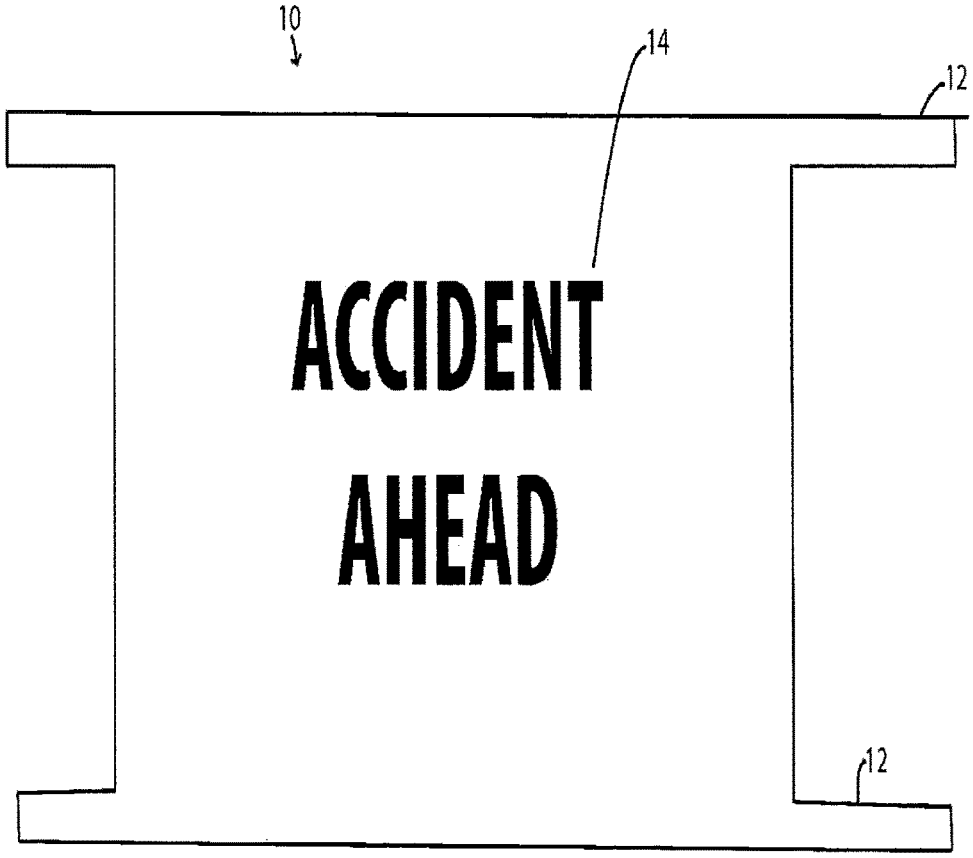
FIG. 1 is a front view of a variable message sign in accordance with one embodiment of the disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order.

It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DESCRIPTION OF EXAMPLES OF THE EMBODIMENTS

Various embodiments of a highway message sign comprise a housing and one or more circuit boards. In many embodiments, each of the one or more circuit boards have a plurality of pixels, and each pixel of the plurality of pixels can include one or more lighting elements. The highway message sign can further comprise a glazing adjacent to the lighting elements and a mask attached to the housing and adjacent to the glazing. The mask can have a plurality of apertures aligned with the plurality of pixels at an offset, wherein each pixel of the plurality of pixels is aligned at a different one of the plurality of apertures such that the one or more lighting elements of any pixel of the plurality of pixels are aligned to the same aperture. The highway message sign can further comprise one or more pins having a first end attached to the mask and a structural return separate from the one or more pins and having a first end attached to the mask. In many embodiments, each of the one or more pins extend from the mask and through the glazing and the one or more pins have a second pin end attached to at least one of the one or more circuit boards.

In some embodiments, the highway variable message sign comprises a mask with a plurality of apertures and a housing having the mask at a front face of the housing, the mask comprising a plurality of apertures. The highway variable message sign can further comprise one or more printed circuit boards comprising a plurality of pixels, wherein each pixel of the plurality of pixels comprises a plurality of lighting elements, wherein each pixel is aligned with at least one of the plurality of apertures at an offset. In many embodiments, the highway variable message sign can comprise a glazing between the mask and the one or more printed circuit boards, one or more pins having a first end attached to the mask, and a center of each pixel is equidistant to an adjacent center of each adjacent pixel. In some embodiments, each of the one or more pins extend from the mask and through the glazing and the one or more pins have a second pin end attached to at least one of the one or more printed circuit boards.

In many embodiments, the highway variable message sign comprises a housing, and a plurality of printed circuit boards. In some embodiments, each of the plurality of printed circuit boards can have a plurality of pixels, and each pixel includes a plurality of lighting elements, wherein the plurality of lighting elements are contained in a single LED. In some embodiments, the highway variable message sign can further comprise a glazing adjacent to the plurality of lighting elements and a mask attached to the housing, adjacent to the glazing, and coupled to the plurality of printed circuit boards. In many embodiments, the mask has a plurality of apertures aligned with the plurality of pixels at an offset, wherein each pixel is aligned at a different one of the plurality of apertures. In some embodiments, the highway message sign further comprises a structural return having a first end attached to the mask.

In many embodiments, the highway variable message sign comprises a housing and a plurality of printed circuit boards coupled to the housing. Each of the plurality of printed circuit boards can have a plurality of pixels, each pixel includes a plurality of lighting elements, wherein the plurality of lighting elements are contained in a single LED. The highway variable message sign further comprises a glazing adjacent to the plurality of lighting elements, and a mask attached to the housing and adjacent to the glazing. The mask can have a plurality of apertures aligned with the plurality of pixels at an offset, wherein each pixel is aligned at a different one of the plurality of apertures. The highway variable message sign can further comprise a structural return having a first end attached to the mask.

Various embodiments of the highway variable message sign with apertures include a highway variable message sign with apertures comprising a housing, a plurality of circuit boards coupled to the housing. In some embodiments, each of the plurality of circuit boards have a plurality of pixels. In some embodiments, each of the plurality of pixels comprise a grouping of lighting elements. In some embodiments, the grouping of lighting elements can be contained in a single package, for example, in a tricolor LED or a RGB LED. In some embodiments, each of the plurality of circuit boards have a plurality of groupings of lighting elements, wherein each of the plurality of groupings of lighting elements contain at least two lighting elements arranged vertically. In some embodiments, the at least two lighting elements arranged vertically can be two amber LEDs. In many embodiments, the vertical arrangement or layout of the lighting elements can limit color shifting or chromatic aberration. In some embodiments, the vertical arrangement of the lighting elements can limit color shifting when viewed from the left or the right side of the lighting elements or the highway variable message sign. The highway variable message sign further comprises a glazing attached to the mask and adjacent to the lighting elements and a mask attached to the housing and adjacent to the glazing, the mask having a plurality of apertures aligned with the plurality of groupings of lighting elements, wherein each of the plurality of apertures has a vertical axis that is longer than a horizontal axis.

In some embodiments, each of the plurality of pixels in any highway variable message sign can comprise two columns of lighting elements. For example, a pixel can comprise 6 LEDs such that there are two columns of three LEDs, and each of the three LEDs can be the same or different colors.

Some embodiments of the highway variable message sign with apertures include a highway variable message sign with apertures comprising a mask with a plurality of apertures, wherein at least one of the plurality of apertures has a vertical axis that is greater than a horizontal axis, a housing having the mask on a front face, a glazing between the mask and an interior of the housing, and a printed circuit board with a group of lighting elements, the group of lighting elements aligned with that at least one of the plurality of apertures.

Various embodiments include a highway variable message sign with apertures comprising a housing and a sign face. In some embodiments, a number of circuit boards are in the housing. Each of the circuit boards can have a number of groupings of lighting elements. In some embodiments, the at least three lighting elements can be contained in a single package, such as a tricolor LED or a RGB LED. In some embodiments, each of the groupings of lighting elements contains at least two lighting elements arranged vertically. In some embodiments, each of the groupings of lighting elements contains at least three lighting elements arranged in a vertical line. Each of the at least two or three lighting elements can be the same or different colors.

In some embodiments, a mask can be attached to the housing and/or next to the glazing. In some embodiments, a mask can be a dark, opaque, sheet of material with optical apertures for the light to shine through that provides contrast between the illuminated portion of the sign and the background of the sign. The mask can be aligned with the groupings of lighting elements, wherein each of the apertures has a vertical axis that is longer than a horizontal axis. In some embodiments, the mask can be aligned with the groupings of lighting elements, wherein each of the apertures has a vertical axis that is equal to the horizontal axis.

Turning to the figures, FIG. 1 is a front view of a variable message sign 10 in accordance with one embodiment of the disclosure. Sign 10 is shown as a standard highway sign 10 mounted on support beams 12 over a roadway. Sign 10 has a message 14 that provides alerts, for example, warning users of an accident ahead.

Figure 2:
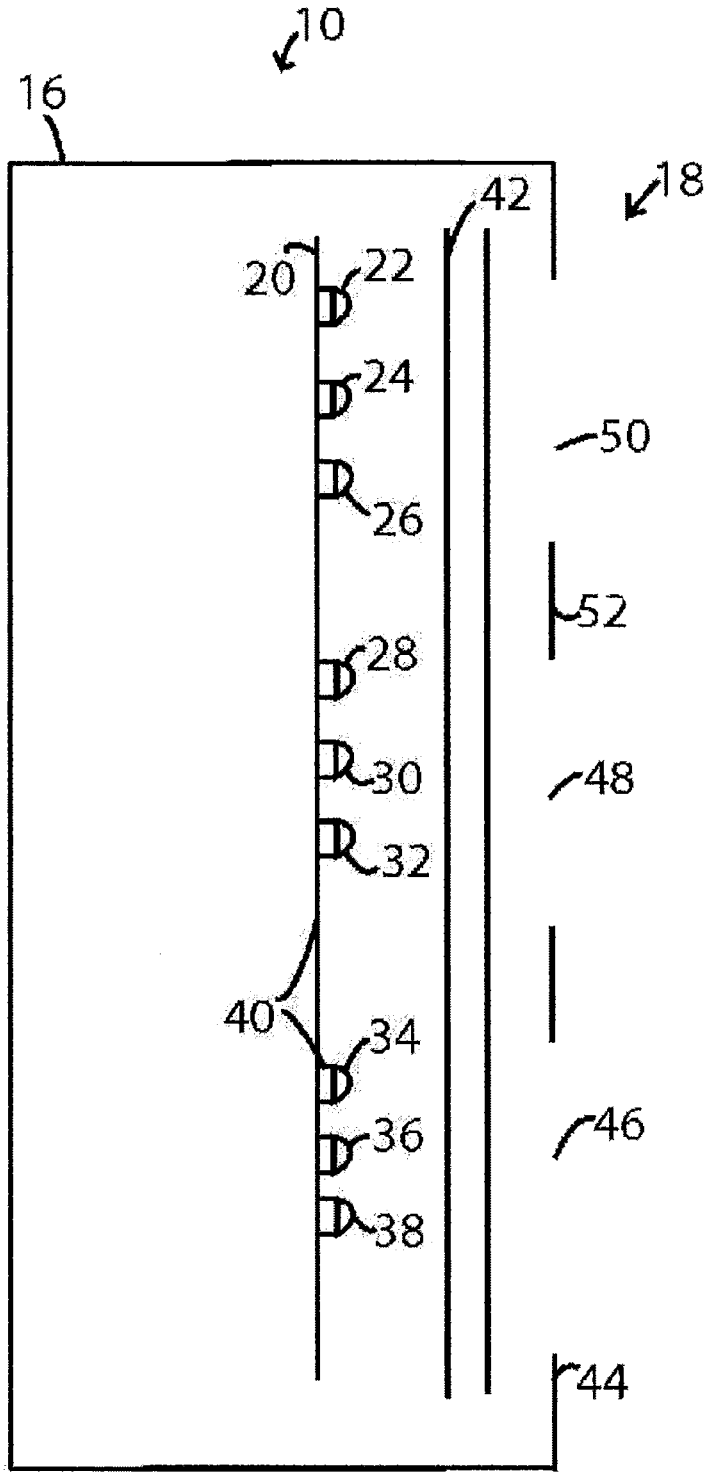
FIG. 2 is a cross-sectional side view of a variable message sign in accordance with one embodiment of the disclosure.

FIG. 2 is a cross sectional side view of sign 10 in accordance with one embodiment of the disclosure. Sign 10 can have a housing 16 with a front face 18. In many embodiments, sign 10 can comprise a printed circuit board (PCB) 20. Printed circuit board 20 has a number of lighting elements, such as LEDs 22, 24, 26, 28, 30, 32, 34, 36, 38. In some embodiments, LEDs 22, 24, 26, 28, 30, 32, 34, 36, 38 are surface mounted LEDs with returns 40 that provides standoff from a surface of printed circuit board 20. Surface mounted means an electronic device in which the leads are soldered to the same surface of the circuit board on which the electronic device is placed, and does not include through-hole technology in which the leads extend through the printed circuit board and are soldered on the opposite surface of the printed circuit board at which the electronic device is located. In some embodiments, LEDs 22, 24, 26, 28, 30, 32, 34, 36, 38 are through hole LEDs. Through hole LEDs require more room than surface mount LEDs. In embodiments with through hole LEDs, the apertures in the mask can be larger than the apertures in the mask for the in surface mounted LEDs in order to accommodate the further spaced out through hole LEDs. In some embodiments, each of LEDs 22, 24, 26, 28, 30, 32, 34, 36, 38 can be square based with round lenses. In some embodiments, each of LEDs 22, 24, 26, 28, 30, 32, 34, 36, 38 can be approximately 4 millimeters to approximately 4.4 millimeters in diameter. In some embodiments, each of LEDs 22, 24, 26, 28, 30, 32, 34, 36, 38 can be approximately 4.2 millimeters in diameter.

Adjacent to printed circuit board 20 is a glazing 42. In some embodiments, glazing 42 can be next to and/or located over the lighting elements. In various embodiments, glazing 42 can be sheet of transparent material that covers the interior of the sign from the elements. In many embodiments, the glazing can be clear. In some embodiments, glazing 42 can be transparent. In many embodiments, glazing 42 can be approximately 0.1 to approximately 0.3 inch thick. In some embodiments, glazing 42 can be approximately 0.25 inch thick. In some embodiments, glazing 42 can be approximately 0.125 inch thick. In many embodiments, glazing 42 can have a minimum ultraviolet (UV) coating of approximately 80 percent. In some embodiments, glazing 42 comprises polycarbonate, acrylic, glass, or other similar materials. In some embodiments, glazing 42 can have an ultimate tensile strength of approximately 9,000 pounds per square inch (psi) to approximately 10,000 psi, a tensile strain at yield of approximately 4 percent to approximately 8 percent, and a tensile modulus of approximately 320,000 psi to approximately 360,000 psi. In some embodiments, glazing 42 can have a flexural modulus of approximately 320,000 psi to approximately 360,000 psi and an impact strength of approximately 12 ft-lbs/inch to approximately 16 ft-lbs/inch. In further embodiments, glazing 42 can have a heat deflection temperature under load value of approximately 265° Fahrenheit (F) to approximately 275° F. under 264 psi to approximately 285° F. to approximately 290° F. under 66 psi. In some embodiments, glazing 42 can have an average initial light transmittance average of 88 percent, a change in light transmittance of less than approximately 5 percent after 5 years of exposure, and a change in yellowness index of less than approximately 5 percent after 5 years of exposure. In many embodiments, the coefficient of thermal expansion of glazing 42 can be approximately $3.7\times10^{-5}$ inch per inch per ° F. to approximately $3.8\times10^{-5}$ inch per inch per ° F.

In front of glazing 42 is a mask 44. In many embodiments, mask 44 can provide contrast and some protection from the elements, including lowering the solar heat gain inside the housing, and can limit the output light of lighting elements, such as LEDs 22, 24, 26, 28, 30, 32, 34, 36, 38, to a particular direction to avoid distracting drivers who do not need to view the sign. Furthermore, mask 44 can limit the color shifting or chromatic aberration that drivers can experience because of the physical separation of the color diodes or different colored lighting elements, such as LEDs 22, 24, 26, 28, 30, 32, 34, 36, 38. In many embodiments, mask 44 can be aluminum and finished with a fluropolymer-based coating system. In some embodiments, mask 44 is finished with a resin, such as a KYNAR 500 resin. In some embodiments, mask 44 can be approximately 0.055 inch thick to approximately 0.070 inch thick. In some embodiments, mask 44 can be approximately 0.080 inch thick to approximately 0.099 inch thick. In many embodiments, mask 44 can have a minimum thickness of approximately 0.063 inch. In other embodiments, mask 44 can have a minimum thickness of approximately 0.090 inch. In some embodiments, the lighting elements do not protrude through mask 44. In some embodiments, the lighting elements do not protrude through mask 44, and the lighting elements are not flush with mask 44. Mask 44 has a plurality of apertures 46, 48, 50 aligned with LEDs 22, 24, 26, 28, 30, 32, 34, 36, 38. In some embodiments, an aperture can be an opening used to limit the light exiting an optical system. In some embodiments, the aperture can be a non-circular ellipse. In other embodiments, the aperture can be stadium shape or an oblong oval with semicircles at each end and straight sides. In other embodiments, the aperture can be any oblong shape. In another embodiment, the aperture can be circular.

Figure 10:
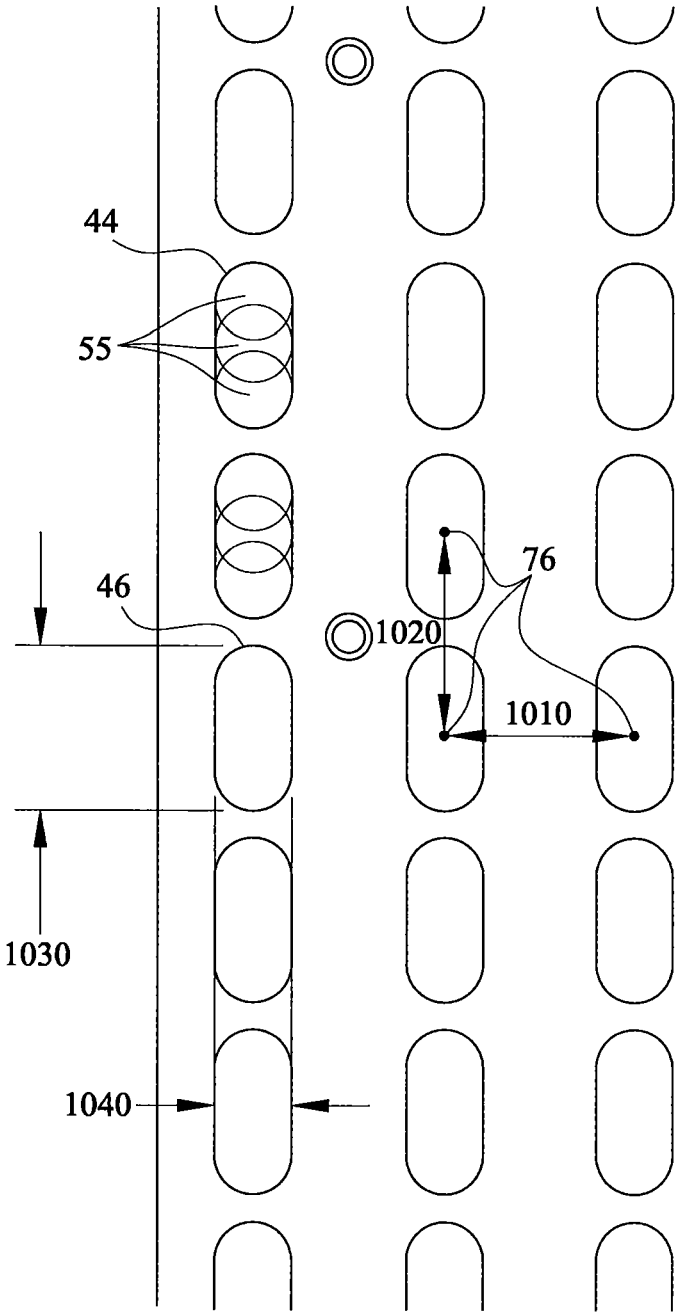
FIG. 10 is a front view of a portion of a variable message sign in accordance with one embodiment of the disclosure.

As shown in FIG. 10, aperture 46, for example, can have a height 1030 and a width 1040. In many embodiments, aperture height 1030 can be approximately 0.6 inch to approximately 0.75 inch. In some embodiments, aperture height 1030 can be approximately 0.75 inch to approximately 1.75 inches. In some embodiments, aperture height 1030 can be approximately 1.0 inch. In many embodiments, aperture width 1040 can be approximately 0.25 inch to approximately 1.25 inches. In some embodiments, aperture height 1030 can be approximately 0.675 inch, and aperture width 1040 can be approximately 0.313 inch. In some embodiments, aperture height 1030 can be approximately 1.56 inches, and aperture width 1040 can be approximately 1.0 inch. In some embodiments, aperture height 1030 can be approximately 1.063 inches, and aperture width 1040 can be approximately 0.688 inch. In some embodiments, aperture height 1030 can be approximately 1.0 inch, and aperture width 1040 can be approximately 0.438 inch. In many embodiments, height 1030, or the major axis of aperture 46, is larger than width 1040, the minor axis of aperture 46. In some embodiments, a stadium shape of aperture 46 can comprise three approximately equivalent overlapping circles 55 having the same diameter, wherein the centers of the three overlapping circles 55 are aligned and can overlap each other by up to one radius. In many embodiments, the top and bottom curvature of the stadium shape is approximately equal to a semicircle of one of overlapping circles 55. In one embodiment, glazing 42 is painted or coated to form mask 44. If the glazing also acts as a mask it can be painted or coated black. In another embodiment, glazing 42 abuts mask 44. In one embodiment, mask 44 is an aluminum sheet with a face 52 painted black and a plurality of apertures.

Sign 10 can also include a controller and environmental monitoring and control equipment. The environmental control systems include filters that have to be replaced, fans to blow air through the sign and in some cases air conditioners or heat exchangers. In some embodiments, a control system such as the control system in U.S. Pat. No. 8,446,293, which is incorporated by reference herein, can be used.

Figure 3:
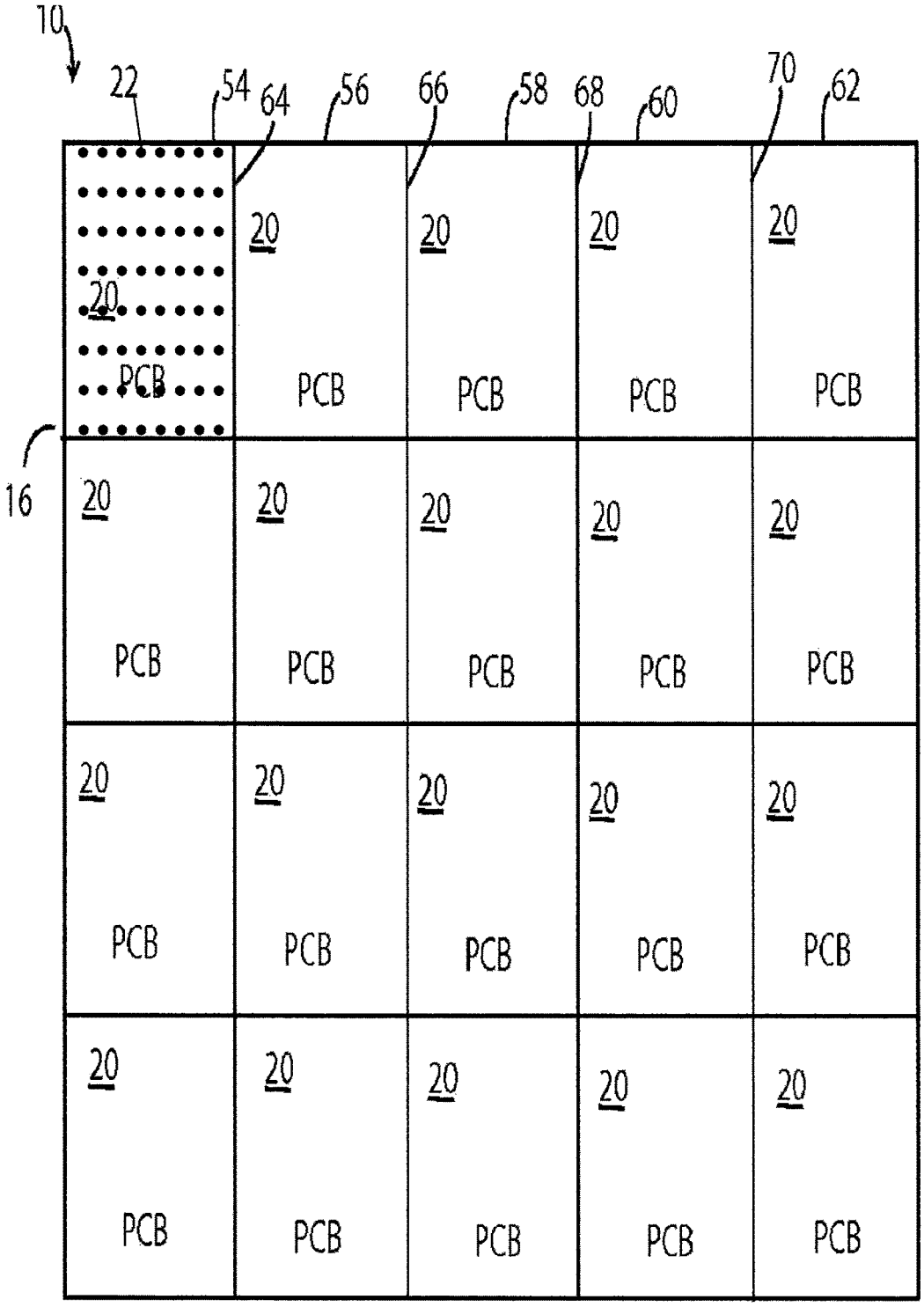
FIG. 3 is a front view of a variable message sign with a mask removed in accordance with one embodiment of the disclosure.

FIG. 3 is a front view of a variable message sign 10 with mask 44 removed in accordance with one embodiment of the disclosure. In some embodiments, sign 10 has multiple columns of printed circuit boards (PCBs) 20. FIG. 3 shows an embodiment of sign 10 with five columns, 54, 56, 58, 60, and 62, of PCB 20. Each PCB 20 has a plurality of LEDs 22.

In many embodiments, PCB 20 is approximately 1 foot by 1 foot in size. In some embodiments, sign 10 has only one PCB 20.

In many embodiments, each PCB 20 can be uniform and can have the same number of rows of pixels as columns of pixels. In many embodiments, the number of apertures, pixels and/or lighting elements can be in factors of eight. For example, in some embodiments, each PCB 20 can have 16 rows of pixels and 16 columns of pixels. As another example, each PCB 20 can have 8 rows of apertures and 8 columns of apertures 46 as shown in the upper left-hand PCB 20 of FIG. 3. In other embodiments, the number of apertures, pixels, and/or lighting elements are not in factors of eight. In some of these embodiments, any one of PCB 20 can have a different number of rows of pixels than columns of pixels. As examples, PCB 20 can have: 5 rows of pixels and 7 columns of pixels; 5 rows of pixels and 9 columns of pixels; 10 rows of pixels and 14 columns of pixels; 10 rows of pixels and 9 columns of pixels; 10 rows of pixels and 7 columns of pixels; or 10 rows of pixels and 18 columns of pixels. In many embodiments, the rows and columns of pixels are evenly spaced such that the center-to-center vertical distance 1020, as shown in FIG. 10, between centers 76 of vertically neighboring pixels is equal to the center to center horizontal distance 1010 between centers 76 of horizontally neighboring pixels. In some embodiments, distance 1020 and/or distance 1010 can be referred to as the pitch. In some embodiments, distance 1020 and/or distance 1010 can be approximately 2.75 inches (approximately 70 millimeters (mm)), approximately 1.875 inches (approximately 48 mm), approximately 1.375 inches (approximately 35 mm), approximately 1.250 inches (approximately 32 mm), or approximately 0.787 inches (approximately 20 mm).

Between columns 54, 56, 58, 60, 62 are structural returns 64, 66, 68, 70 that hold PCBs 20. Structural returns 64, 66, 68, 70 are thin enough to fit between columns 54, 56, 58, 60, 62 while allowing the distances between the centers of neighboring pixels between PCBs to remain consistent with the distances between the centers of neighboring pixels on a same PCB. In embodiments with one PCB 20, structural returns can be optional. Structural returns 64, 66, 68, 70 can provide support to mask 44 and can withstand wind loading according to various highway sign safety requirements. In some embodiments, one or more structural returns 64, 66, 68, 70 can be bent another 90 degrees.

Figure 4:
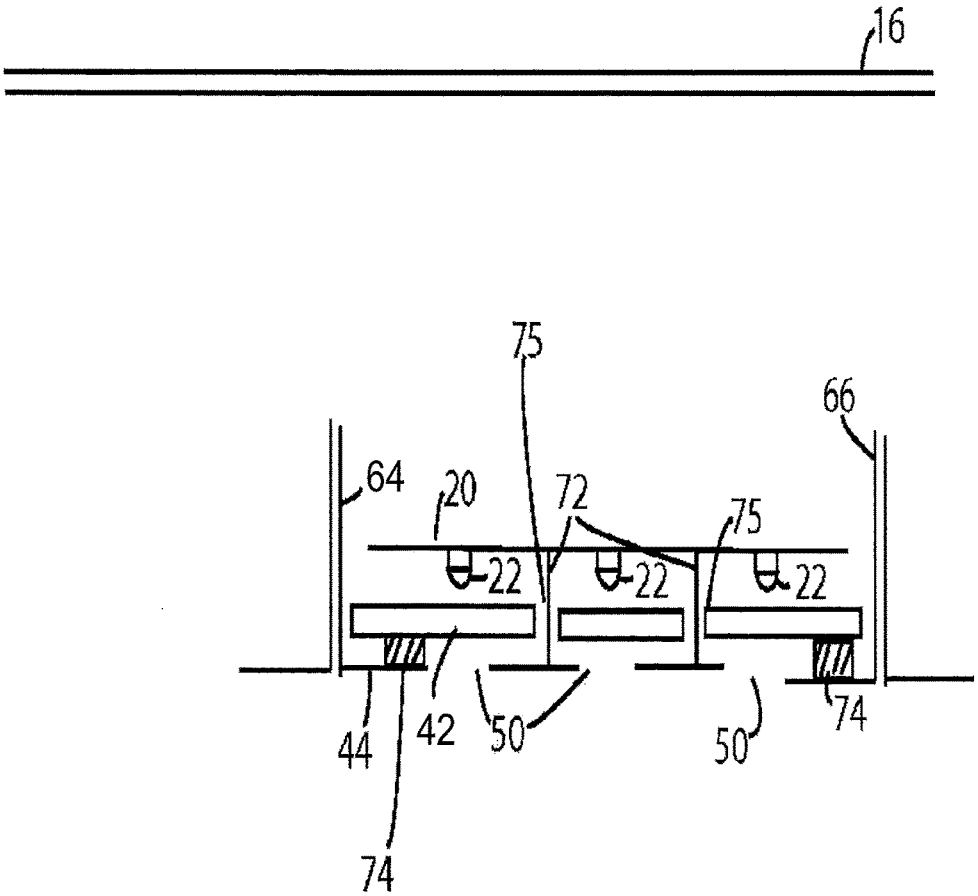
FIG. 4 is a cross-sectional partial top view of a variable message sign in accordance with one embodiment of the disclosure.

In some embodiments, a sheet of glazing 42 (as shown in FIG. 4) is adjacent to each column 54, 56, 58, 60, 62 of PCBs 20. For example, in an embodiment where there are five columns 54, 56, 58, 60, 62, there are also five glazings 42, wherein each glazing 42 covers one of columns 54, 56, 58, 60, 62. In other embodiments, a sheet of glazing 42 is adjacent to more than one of columns 54, 56, 58, 60, 62 of PCBs 20.

Figure 8:
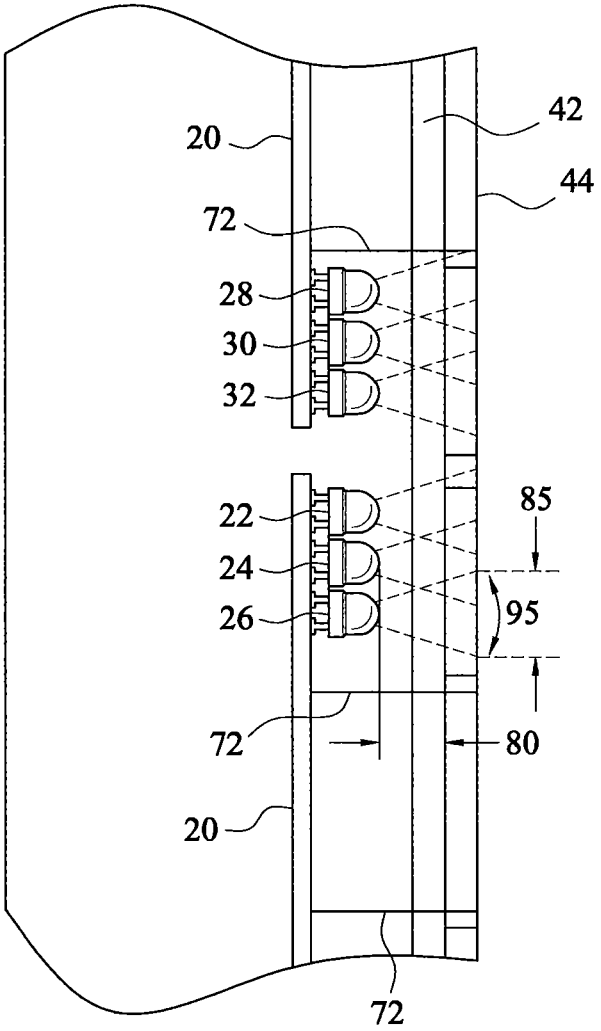
FIG. 8 is a cross-sectional side view of a portion of a variable message sign in accordance with one embodiment of the disclosure.
Figure 9:
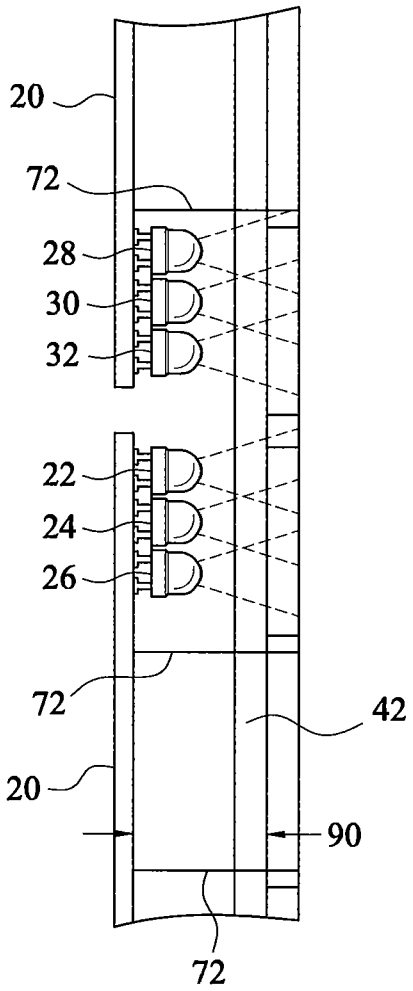
FIG. 9 is a cross-sectional side view of a portion of a variable message sign in accordance with one embodiment of the disclosure.

FIG. 4 is a cross sectional partial top view of a variable message sign in accordance with one embodiment of the disclosure. This view shows printed circuit board 20 is attached to mask 44 by pins 72. Pins 72 can hold PCB 20 in place. In many embodiments, each of pins 72 can be a threaded rod or threaded insert, such as PEM brand fasteners. In some embodiments, pins 72 can be pressed into the sign face. In some embodiments, pins 72 can have a length 90, as shown in FIG. 9, that is long enough to allow PCB 20 to be spaced from glazing 42. For example, in some embodiments, length 90 of pins 72, as shown in FIG. 9, can be approximately 0.55 inch to approximately 0.60 inch long. The embodiment in FIG. 9 can comprise more pixels than shown. Some elements of the embodiment in FIG. 9 have been removed from the figure to help explain concepts. In other embodiments, the exposed portions of pins 72 can be approximately 0.57 inch long. In other embodiments, pins 72 can be any length that keeps LEDs 22, 24, and 26 a distance 80 from mask 44, as shown in FIG. 8. In some embodiments, distance 80 can be approximately 0.28 inch to approximately 0.33 inch. In various embodiments, distance 80 can be approximately 0.31 inch.

In some embodiments, glazing 42 can be attached to mask 44 by rivets, screws, welds, fasteners, adhesives, and/or tapes. In various embodiments, glazing 42 can be floated, by placing rubber seals between glazing 42 and mask 44. In some embodiments, a bead of silicon can be used to form a weather-tight seal between glazing 42 and mask 44. In many embodiments, glazing 42 can be attached to mask 44 by a two sided tape 74. For example, tape 74 can be an ultra high bond tape or very high bond tape, such as VHB™ tape from 3M. In some embodiments, tape 74 can be approximately 0.12 inch to approximately 0.13 inch thick. In some embodiments, tape 74 can be approximately 0.125 inch thick. Tape 74 can seal the surface of mask 44 to the surface of glazing 42, and can leave an air gap between glazing 42 and mask 44. In some embodiments, tape 74 can be a thermal expansion intermediator. Tape 74 can be an intermediating layer between glazing 42 and mask 44 and expand to compensate for distinct coefficients of thermal expansion of glazing 42 and mask 44. In some embodiments, tape 74 is a thermal intermediator and can allow or compensate for the differences in the coefficients of thermal expansion of mask 44 and glazing 42. For example, in some embodiments, as the temperature increases, glazing 42 can expand or increase in size more rapidly than mask 44. Tape 74 is pliable or flexible enough that it can allow for the difference in expansion without damaging mask 44 or glazing 42, and while maintaining a seal and adhesion. In some embodiments, tape 74 has a coefficient of thermal expansion that can allow for thermal insulation and/or thermal isolation of glazing 42 from mask 44. The glazing 42 has through holes 75 through which pins 72 pass. In one embodiment, structural returns 64, 66 are formed by bending the edges of mask 44 inward.

Figure 5:
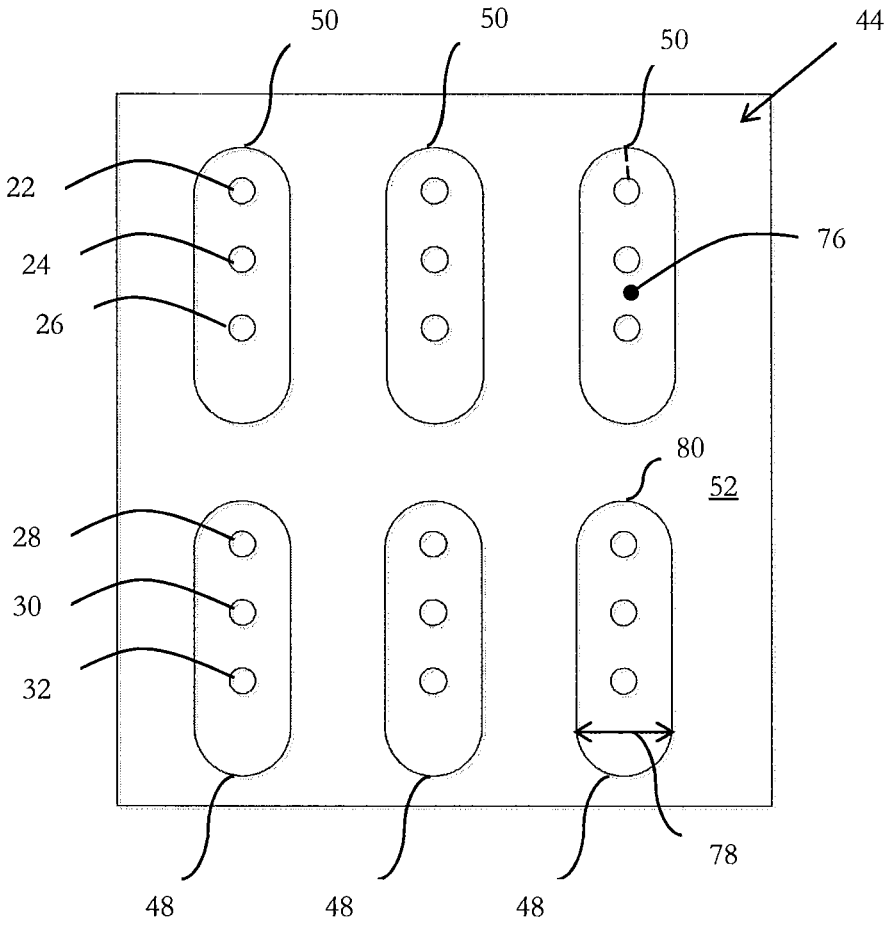
FIG. 5 is partial front view of a mask of a variable message sign in accordance with one embodiment of the disclosure.

FIG. 5 is partial front view of a portion of a mask 44 of a variable message sign in accordance with one embodiment of the disclosure. Mask 44 has a number of apertures 48, 50. The apertures 48, 50 are aligned with LEDs 22, 24, 26, 28, 30, 32. LEDs 22, 24, 26 form a line segment centered around LED 24 that is vertical when the sign is in place. Similarly, LEDs 28, 30, and 32 form a line segment centered around LED 30 that is vertical when the sign is in place. In many embodiments, a LED pitch 89 can be approximately 0.25 inch. In some embodiments, the LED pixel pitch 89 can be approximately 0.183 inch. Note that lighting elements other than standard LEDs can be used with the disclosure. For example, other lighting elements such as fiber optics, field-induced polymer electroluminescents (FIPELs), laser-based lighting, organic LEDs, tricolor LEDs, RGB LEDs, and other lighting elements can be used with the disclosure.

Center 76 of the aperture is offset from the center of the line segment formed by the LEDs. In some embodiments, center 76 can be located within the bottom third of the line segment formed by the LEDs. In other embodiments, center 76 can be located below the bottom LED in the line segment formed by the LEDs. Other shaped apertures can be used and also can be offset similarly. In some embodiments, to display a full color range, each aperture 48, 50 of the sign has a red, a green, and a blue LED 22, 24, 26. In some embodiments, the red, green, and blue LEDs 22, 24, 26 can be in any order. In other embodiments, the red, green, and blue LEDs 22, 24, 26 can be in the order of red green blue from top to bottom of the pixel defined by the aperture.

In many embodiments, the line of LEDs 22, 24, 26 can be as close to each other as possible depending on manufacturing tolerances to allow for color blending. In many embodiments, LEDs in a single pixel are no further apart from each other than 1 diameter of an LED bulb. In some embodiments, LEDs in a single pixel are no further apart from each other than half a diameter of an LED bulb. In some embodiments, each pixel of the plurality of pixels can comprise only two lighting elements, for example two amber or yellow LEDs. In many embodiments, each pixel of the plurality of pixels comprise three LEDs. In another embodiment, some systems may use four LEDs with different colors. For example, in some embodiments, a pixel comprises four LEDs, including a red LED, a green LED, a blue LED, and a yellow LED. In another example, a pixel can comprise four LEDs, including a red LED, a green LED, a blue LED, and a tricolor LED. In another embodiment, a pixel comprises three tricolor LEDs. In yet another embodiment, a pixel comprise two red LEDs, a green LED, and a blue LED. In other embodiments, a pixel can comprise more than three LEDs and can comprise any combination of LEDs or other lighting element colors. In another embodiment, a pixel comprises only one LED, namely a tricolor LED.

In some embodiments, width 78 can be approximately equal to the diameter of the LED bulb. In some embodiments, the width 78 of the aperture can be large enough to encompass at least the full angular beam of the light output from LEDs 22, 24, 26. In other embodiments, the width 78 of the aperture can be large enough to encompass approximately half of the full angular beam of the light output from LEDs 22, 24, 26 when measured at the aperture or mask 44. In many embodiments, a narrow viewing or beam angle can be used to decrease motorist distraction. For example, a beam angle 95 (FIG. 8) can be aimed towards a motorist so that sign 10 can be read at a relatively convenient time. In some embodiments, beam angle 95 (FIG. 8) can assist in lowering light pollution from sign 10. In some embodiments, beam angle 95 (FIG. 8) can comprise an LED with a 30 degree half-width beam angle. In some embodiments, beam angle 95 (FIG. 8) can comprise an LED with a 23 degree half-width beam angle. In other embodiments, beam angle 95 (FIG. 8) can comprise an LED with a 15 degree half-width beam angle. In embodiments using a 15 degree half-width beam angle, apertures can be smaller than the apertures used with 30 degree half-width beam angle LEDs. In some embodiments, width 78 of apertures 48, 50 can be at least as large as width 85 (FIG. 8) of the beam, as measured when the beam reaches the aperture or when the beam reaches mask 44. In some embodiments, width 78 of apertures 48, 50 can be approximately equal to width 85 (FIG. 8) of the beam, as measured when the beam reaches the aperture or when the beam reaches mask 44. In some embodiments, width 78 of apertures 48, 50 can be approximately 1 percent larger than width 85 (FIG. 8) of the beam, as measured when the beam reaches the aperture or when the beam reaches mask 44. In some embodiments, width 78 of apertures 48, 50 can be at least as large as width 85 (FIG. 8) of the beam from the 30 degree half-width LED, as measured when the beam reaches the aperture or when the beam reaches mask 44, regardless of whether sign 10 comprises the 15 degree half-width LED, the 23 degree half-width LED, or the 30 degree half-width LED. The embodiment in FIG. 8 can comprise more pixels than shown. Some elements of the embodiment in FIG. 8 have been removed from the figure to help explain concepts.

The aperture is offset from the center of the line segment formed by LEDs 22, 24, 26, where the center is based on the position of LED 24 as noted above, because the sign is located above the motorist. In some embodiments, the motorist viewing angle can be when the line of sight resides within the LED's cone of vision. The motorist viewing angle is such that the aperture might no longer be offset from the center of the line segment formed by the line of LEDs 22, 24, and 26, and such that mask 44 does not cut off the view of LEDs 22, 24, 26. A larger aperture that is not offset can provide less contrast than a smaller, offset aperture. For example, an aperture with larger major and minor axes would provide less contrast than a smaller but offset aperture. Because the aperture is offset, it is possible that top 80 of aperture 48 may impede the cone of light from the top LED 22, 28 when viewing straight on. However, in many embodiments, a motorist may not be viewing the sign from above or straight on, so the offset has no effect on the readability of the sign. The aperture provides room for returns and allows the face to be manufactured. In one embodiment, the sign may have only two or one lighting element per aperture 48, 50. The lighting elements may all be the same color, a single color, or only two colors may be used. If the lighting elements are all the same color or the single color, the single color can be amber, in one embodiment. The disclosure is not limited any particular number of color of lighting elements or to fine pitch signs.

Figure 6:
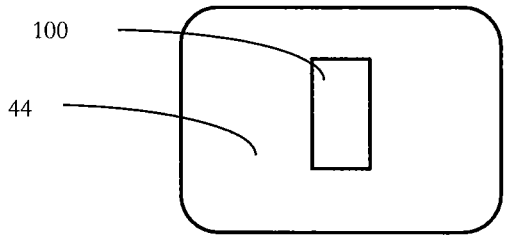
FIG. 6 is a front view of an embodiment of an aperture in accordance with one embodiment of the disclosure.

FIG. 6 is a front view of an embodiment of an aperture 100, similar to aperture 48 in FIGS. 2 and 5, in mask 44, in accordance with one embodiment of the disclosure. In this example the aperture 100 is a rectangle, although any oblong polygon might be used.

Figure 7:
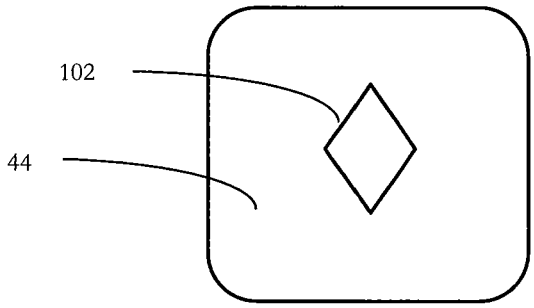
FIG. 7 is a front view of an embodiment of an aperture in accordance with one embodiment of the disclosure.

FIG. 7 is a front view of an embodiment of an aperture 102, similar to aperture 46 in FIGS. 2 and 5 in mask 44, in accordance with one embodiment of the disclosure. In this embodiment, aperture 102 is a diamond shape, and variations on this shape are possible as long as the vertical axis is longer than the horizontal axis.

Thus there has been described a highway variable message sign with apertures that limits the output light to the drivers needing to see the sign and therefore not distracting drivers who do not need to see the sign.

While the disclosure has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

Additional examples of such changes have been given in the foregoing description. Accordingly, the disclosure of embodiments of highway variable message sign with apertures is intended to be illustrative of the scope of highway variable message signs with apertures and is not intended to be limiting. For example, in one embodiment, a highway sign may have one or more features of FIG. 1, with or without the features described with reference to FIGS. 2-10. Other permutations of the different embodiments having one or more of the features of the various figures are likewise contemplated. It is intended that the scope of highway variable message sign with apertures shall be limited only to the extent required by the appended claims.

The highway variable message sign discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of a highway variable message sign with apertures, and may disclose alternative embodiments of the highway variable message sign with apertures.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A highway variable message sign comprising:

a housing;

one or more circuit boards;

a plurality of pixels coupled to the one or more circuit boards, each pixel of the plurality of pixels includes one or more lighting elements arranged to have a center line segment of the one or more lighting elements;

a glazing adjacent to, but separated from, the one or more lighting elements;

a mask attached to the housing and adjacent to the glazing, the mask having a plurality of apertures aligned with the plurality of pixels at an offset relative to the center line segment of the one or more lighting elements, wherein each pixel of the plurality of pixels is aligned at a different one of the plurality of apertures such that the one or more lighting elements of any single pixel of the plurality of pixels are aligned to a single aperture within the plurality of apertures; and a structural return having a first end attached to the mask.

2. The highway variable message sign of claim 1, wherein:

an aperture width of each of the plurality of apertures is approximately equal to a beam width of the one or more lighting elements; and the beam width is measured at the mask while the one or more lighting elements and the mask are assembled within the highway variable message sign.

3. The highway variable message sign of claim 2, wherein:

each of the one or more lighting elements comprises a 15 degree half-width LED.

4. The highway variable message sign of claim 1, wherein:

the one or more lighting elements are surface mounted LEDs.

5. The highway variable message sign of claim 1, wherein:

the one or more lighting elements are all a single color.

6. The highway variable message sign of claim 1, wherein:

the one or more lighting elements comprise at least two LEDs within each pixel of the plurality of pixels; and the at least two LEDs have a single color.

7. The highway variable message sign of claim 1, wherein:

the one or more lighting elements comprise at least two different colors within each pixel of the plurality of pixels.

8. The highway variable message sign of claim 1, wherein:

each of the plurality of apertures is a stadium shape.

9. The highway variable message sign of claim 1, wherein:

each of the plurality of apertures is a rectangle.

10. The highway variable message sign of claim 1, further comprising:

a tape securing the glazing to the mask, wherein the tape is a thermal intermediator between the glazing and the mask.

11. The highway variable message sign of claim 10, wherein:

the mask is approximately 0.12 inch to approximately 0.13 inch from the glazing while the mask is assembled within the highway variable message sign.

12. The highway variable message sign of claim 1, wherein:

the glazing obstructs access to the one or more circuit boards and the one or more lighting elements from a front of the highway variable message sign by covering the one or more circuit boards and the one or more lighting elements.

13. The highway variable message sign of claim 1, further comprising:

one or more pins having first pin ends attached to the mask;

wherein:

each of the one or more pins extend from the mask and through the glazing; and the one or more pins have second pin ends.

14. The highway variable message sign of claim 13, wherein:

the structural return is separate from the one or more pins; and the second pin ends are attached to at least one of the one or more circuit boards.

15. The highway variable message sign of claim 13, wherein:

the structural return is separate from the one or more pins; and the one or more circuit boards are attached only to the mask and only via the one or more pins.

16. A highway variable message sign comprising:

a mask with a plurality of apertures;

a housing having the mask at a front face of the housing;

one or more printed circuit boards comprising a plurality of pixels, wherein each pixel of the plurality of pixels comprises a plurality of lighting elements, wherein each pixel is aligned with at least one of the plurality of apertures at an offset from a center of the plurality of apertures; and a glazing between the mask and the one or more printed circuit boards;

wherein a center of each pixel is equidistant to an adjacent center of each vertically or horizontally adjacent pixel.

17. The highway variable message sign of claim 16, wherein:

an aperture width of each of the plurality of apertures is approximately equal to a beam width of the plurality of lighting elements; and the beam width is measured at the mask when the plurality of lighting elements and the mask are assembled within the highway variable message sign.

18. The highway variable message sign of claim 17, wherein:

each of the plurality of lighting elements comprises a 15 degree half-width LED.

19. The highway variable message sign of claim 16, wherein:

each of the plurality of apertures has a vertical axis that is greater than a horizontal axis.

20. The highway variable message sign of claim 16, wherein:

each of the plurality of lighting elements comprise an LED.

21. The highway variable message sign of claim 16, wherein:

each of the plurality of lighting elements comprise a single color.

22. The highway variable message sign of claim 16, wherein:

the plurality of apertures comprise a stadium shape.

23. The highway variable message sign of claim 16, further comprising:

a tape securing the glazing to the mask, wherein the tape is a thermal intermediator between the glazing and the mask.

24. The highway variable message sign of claim 23, wherein:

the mask is approximately 0.12 inch to approximately 0.13 inch from the glazing when the plurality of lighting elements and the mask are assembled within the highway variable message sign.

25. The highway variable message sign of claim 16, wherein:

the glazing obstructs access to the one or more printed circuit boards and the plurality of lighting elements from a front of the highway variable message sign by covering the one or more printed circuit boards and the plurality of lighting elements.

26. The highway variable message sign of claim 16, further comprising:

one or more pins having first pin ends attached to the mask;

wherein:

each of the one or more pins extend from the mask and through the glazing; and the one or more pins have second pin ends.

27. The highway variable message sign of claim 26, wherein:

the second pin ends are attached to at least one of the one or more printed circuit boards.

28. The highway variable message sign of claim 26, wherein:

the one or more printed circuit boards are attached only to the mask and only via the one or more pins.

29. A highway variable message sign, comprising:

a housing;

a plurality of printed circuit boards, each of the plurality of printed circuit boards having a plurality of pixels, each pixel of the plurality of pixels includes a plurality of lighting elements, wherein the plurality of lighting elements are contained in a single LED;

a glazing adjacent to the plurality of lighting elements;

a mask attached to the housing, adjacent to the glazing, and coupled to the plurality of printed circuit boards, the mask having a plurality of apertures aligned with the plurality of pixels at an offset configured to allow the plurality of apertures to block at least a portion of a beam angle from one or more of the plurality of pixels in a first vertical direction while not blocking the beam angle from the one or more of the plurality pixels in a second vertical direction that is opposite the first vertical direction, wherein each pixel of the plurality of pixels is aligned at a different one of the plurality of apertures; and a structural return having a first end attached to the mask.

30. The highway variable message sign of claim 29, wherein:

an aperture width of each of the plurality of apertures is approximately equal to a beam width of the single LEDs; and the beam width is measured at the mask when the single LEDs and the mask are assembled within the highway variable message sign.

31. The highway variable message sign of claim 21, wherein:

the glazing obstructs access to the plurality of printed circuit boards and the single LED from a front of the highway variable message sign by covering the plurality of printed circuit boards and the single LEDs.

32. The highway variable message sign of claim 29, further comprising:

one or more pins having first pin ends attached to the mask;

wherein:

each of the one or more pins extend from the mask and through the glazing;

and the one or more pins have second pin ends.

33. The highway variable message sign of claim 32, wherein:

the second pin ends are attached to at least one of the plurality of printed circuit boards.

34. The highway variable message sign of claim 32, wherein:

the plurality of printed circuit boards are attached only to the mask and only via the one or more pins.

35. A highway variable message sign comprising:

a housing;

one or more circuit boards, each of the one or more circuit boards having a plurality of pixels, and each pixel of the plurality of pixels includes one or more lighting elements;

a glazing adjacent to the one or more lighting elements;

a mask attached to the housing and adjacent to the glazing, the mask having a plurality of apertures aligned with the plurality of pixels such that the one or more lighting elements of any single pixel of the plurality of pixels are aligned to a single aperture within the plurality of apertures; and a structural return having a first end attached to the mask;

wherein:

an aperture width of each of the plurality of apertures is approximately equal to a beam width of the one or more lighting elements, wherein the plurality of apertures are aligned with the plurality of pixels at an offset relative to a center portion of the plurality of apertures; and the beam width is measured at the mask while the one or more lighting elements and the mask are assembled within the highway variable message sign.

36. The highway variable message sign of claim 35, wherein:

each of the one or more lighting elements comprises a 15 degree half-width LED.

37. The highway variable message sign of claim 35, wherein:

the one or more lighting elements comprise surface mounted LEDs.

38. The highway variable message sign of claim 35, wherein:

the one or more lighting elements are all a single color.

39. The highway variable message sign of claim 35, wherein:

the one or more lighting elements comprise at least two LEDs within each pixel of the plurality of pixels; and the at least two LEDs have a single color.

40. The highway variable message sign of claim 35, wherein:

the one or more lighting elements comprise at least two different colors within each pixel of the plurality of pixels.

41. The highway variable message sign of claim 35, wherein:

each of the plurality of apertures is a stadium shape.

42. The highway variable message sign of claim 35, further comprising:

a tape securing the glazing to the mask, wherein the tape is a thermal intermediator between the glazing and the mask.

43. The highway variable message sign of claim 42, wherein:

the mask is approximately 0.12 inch to approximately 0.13 inch from the glazing while the mask is assembled within the highway variable message sign.

44. The highway variable message sign of claim 35, further comprising:

one or more pins having first pin ends attached to the mask;

wherein:

each of the one or more pins extend from the mask and through the glazing;

and the one or more pins have second pin ends.

45. The highway variable message sign of claim 44, wherein:

the structural return is separate from the one or more pins; and the second pin ends are attached to at least one of the plurality of printed circuit boards.

46. The highway variable message sign of claim 44, wherein:

the structural return is separate from the one or more pins; and the plurality of printed circuit boards are attached only to the mask and only via the one or more pins.

* * * * *